US006663406B1

(12) United States Patent
Wu

(10) Patent No.: US 6,663,406 B1
(45) Date of Patent: Dec. 16, 2003

(54) SLANTED ELECTRICAL CONNECTOR HAVING BOARD LOCK

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/246,509

(22) Filed: Sep. 17, 2002

(51) Int. Cl.[7] ..... H01R 13/62

(52) U.S. Cl. ..... 439/326; 439/567; 439/570; 439/947

(58) Field of Search ..... 439/326, 327, 439/947, 567, 570–575

(56) References Cited

U.S. PATENT DOCUMENTS 5,295,843 A * 3/1994 Davis et al. ..... 439/108
5,961,346 A * 10/1999 Choy ..... 439/567
6,012,952 A * 1/2000 Choy et al. ..... 439/637
6,024,602 A * 2/2000 Mchugh et al. ..... 439/567
6,086,417 A * 7/2000 Hsiao et al. ..... 439/567
6,540,540 B1 * 4/2003 Tobey ..... 439/327
6,589,077 B1 * 7/2003 Wu ..... 439/567

* cited by examiner

*Primary Examiner*—Truc T Nguyen
(74) *Attorney, Agent, or Firm*—Wei Te Chung

(57) ABSTRACT

An electrical connector (1) includes an insulative housing (20), a number of electrical contacts (30) mounted to the insulative housing, and a pair of board locks (40). The insulative housing has a base portion (21) defines a mating face (25) and a mounting face (26) obliquely arranged with respect to the mating face, and a mating tongue (22) from the mating face and defining an angle α with respect to the mounting face. The base portion is formed with a pair of mounting ends (23) each defining a cavity (230). The board locks are inserted in an upper and front direction into the cavities of the insulative housing and each of the board locks is formed with a pair of spaced teeth (410), an upper tab (411) and a lower tab (412) to retain to the insulative housing.

1 Claim, 9 Drawing Sheets

SLANTED ELECTRICAL CONNECTOR HAVING BOARD LOCK

BACKGROUND OF THE INVENTION

1. Field of the Invention

The present invention relates to an electrical connector, and particularly to a slanted electrical connector comprising a metallic board lock.

2. Description of the Related Art

Introduced in the 1980s, the Parallel ATA (Advanced Technology Attachment) interface has been the dominant PC storage interface protocol for many years for desktop and portable computers due to the following three primary reasons: low cost, simplicity and high performance.

However, people in the recent years find the Parallel ATA interface dissatisfying for the present needs due to the following pressing drawbacks: firstly, Parallel ATA requires 5-volt transceivers, which imposes integration problems with new silicon processes. On the other hand, evolving parallel ATA beyond 100 MB/sec could require the implementation of technical enhancements, including Low Voltage Differential (LVD) signaling.

Secondly, the electrical connector used for the Parallel ATA interface is featured in high pin count, thereby often having problems in manufacturing, assembling and using. Furthermore, the ribbon header connector can be difficult to seat in the system board during the assembly processes, and can lead to reliability and support issues.

Finally, the 80-conductor cable required to support parallel ATA is relatively expensive and unwieldy to route inside the PC chassis, even worse, the flat ribbon cable used can interfere with air flow and cooling.

Therefore, people in the pertinent art are developing another interface called serial ATA interface to overcome the above-mentioned shortcomings of Parallel ATA interface. Electrical connectors for the serial ATA interface comprise less pin counts than electrical connectors for parallel ATA interface, for example, one type of serial ATA connector comprises only 7 electrical contacts while another type of serial ATA connector comprises only 22 electrical contacts.

The assignee of this application is endeavoring in developing the serial ATA connectors and has disclosed some earlier designs related thereto with the co-pending U.S. application Ser. No. 10/159,458 filed on May 31, 2002 and entitled ELECTRICAL CONNECTOR WITH SELF-RETAINING BOARD LOCKS, with the Ser. No. 10/215,977 filed on Aug. 8, 2002 and entitled ELECTRICAL CONNECTOR WITH IMPROVED TERMIANL RETAINING SYSTEM, with the Ser. No. 10/210,383 filed on Jul. 31, 2002 and entitled TWO PORTS INTEGRAL ELECTRICAL CONNECTOR.

The above mentioned co-pending applications of the assignee the same as this application disclose electrical connectors either in horizontal type or in vertical type. However, some times people want the electrical connector to be somewhat slanted, that is, a mating face of the electrical connector is obliquely arranged with respect to a mounting face, thereby a vertical height of the electrical connector and a space, i.e., the horizontal dimension, occupied by the electrical connector on a printed circuit board being able to get an acceptable balance therebetween.

U.S. Pat. Nos. 4,917,624, 5,041,005, 5,460,537, 5,511,985, and 5,961,346 respectively disclose slanted electrical connectors. All the slanted electrical connectors disclosed in the above mentioned patents are in high pin counts and mate with memory cards inserted into slots thereof. Nevertheless, the serial ATA connector with which we are now concerned is featured in lower pin count and is mated with a complementary cable connector.

Therefore, an electrical connector is desired to match the needs.

SUMMARY OF THE INVENTION

A major object of the present invention is to provide an electrical connector defining a mating face obliquely arranged with respect to a mounting face thereof.

Another object of the present invention is to provide an electrical connector which comprises a small number of electrical contacts and a metallic board lock to secure the electrical connector to a printed circuit board.

An electrical connector in accordance with the present invention comprises an insulative housing, a plurality of electrical contacts and a pair of board locks. The insulative housing comprises a base portion defining a mating face and a mounting face, and a mating tongue extending from the mating face. The mating face and the mounting face are arranged obliquely with respect to each other so that an angle $\alpha$ is defined between the mating tongue and the mounting face. The angle $\alpha$ is less than 90 degrees.

The base portion comprises a pair of mounting ends each defining a cavity and the board locks are inserted in an upward and forward direction into the cavity. Each board lock is formed with a pair of spaced teeth, an upper tab and a lower tab to provide a retention to the insulative housing.

Other objects, advantages and novel features of the invention will become more apparent from the following detailed description of the present embodiment when taken in conjunction with the accompanying drawings.

DETAILED DESCRIPTION OF THE INVENTION

Figure 1:
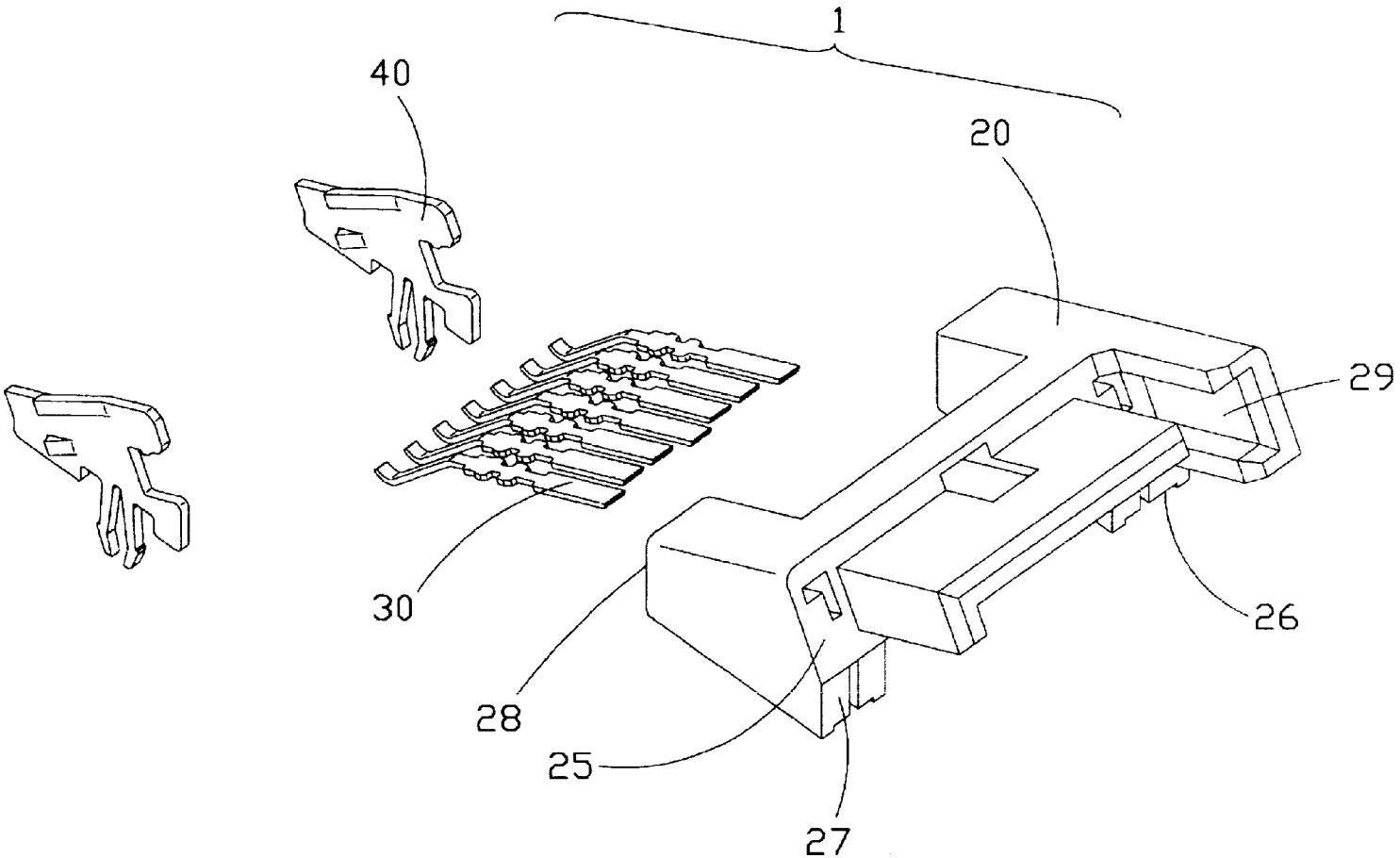
FIG. 1 is an exploded view of an electrical connector in accordance with the present invention.
Figure 2:
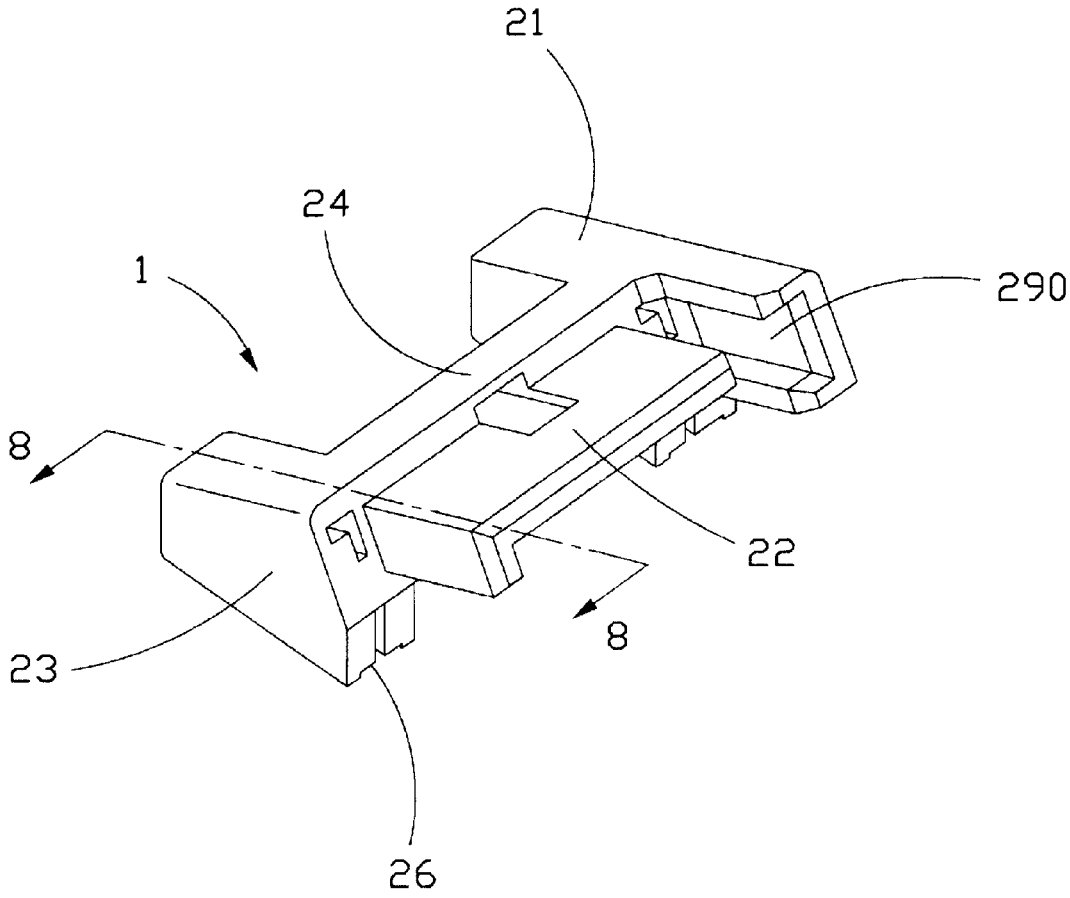
FIG. 2 is an assembled perspective view of the electrical connector of FIG. 1.
Figure 3:
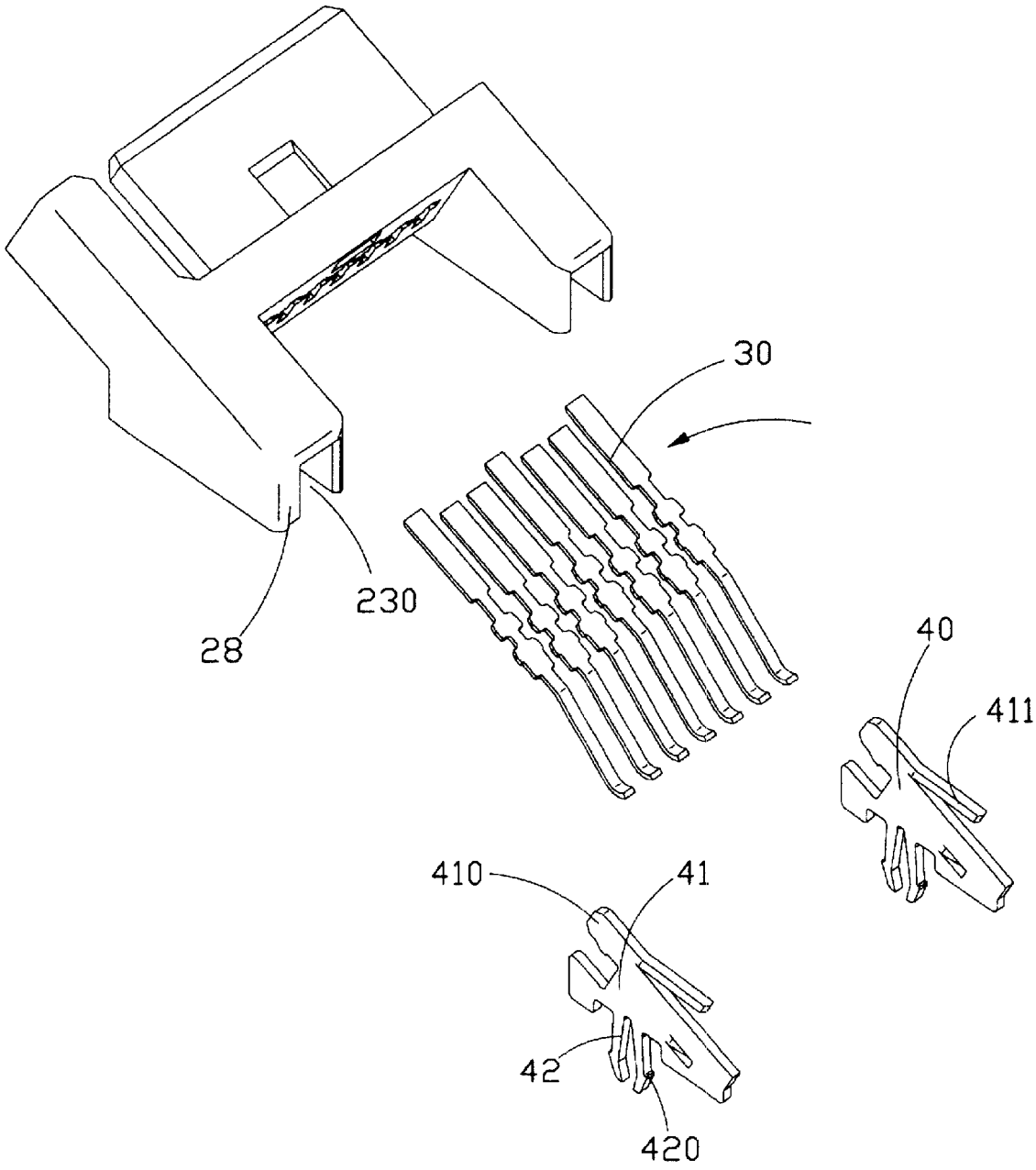
FIG. 3 is a view similar to FIG. 1, but taken from another perspective.
Figure 4:
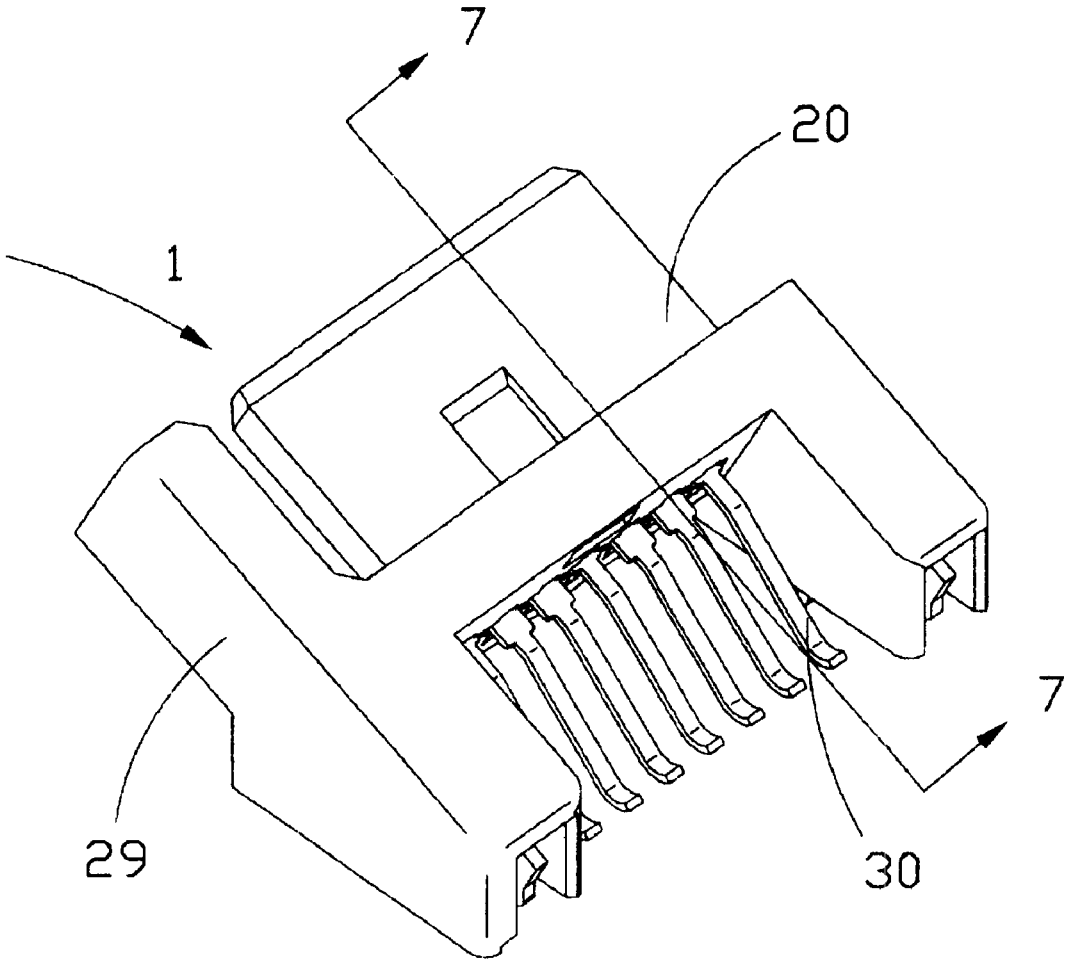
FIG. 4 is an assembled perspective view of FIG. 3.
Figure 5:
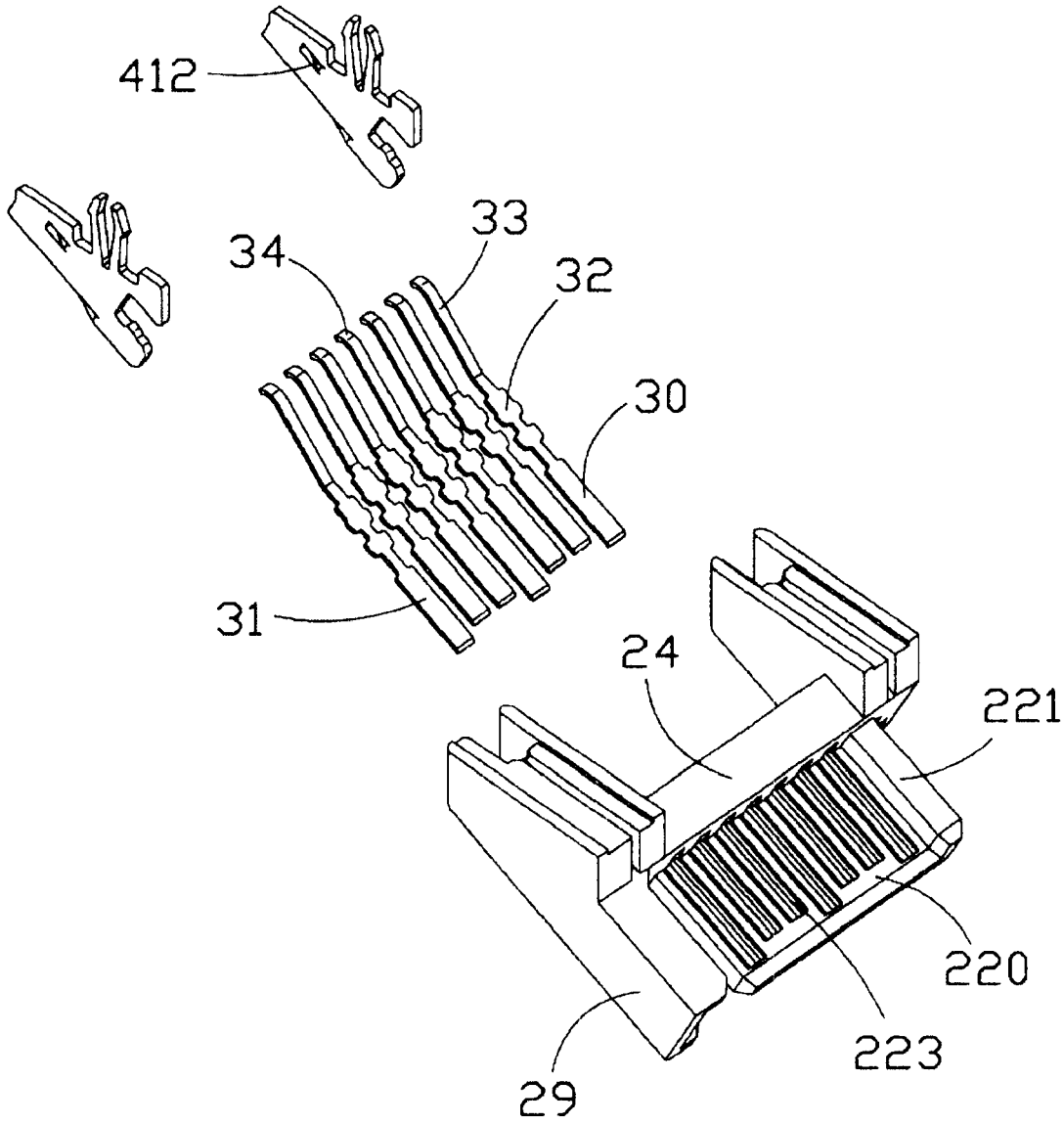
FIG. 5 is a view similar to FIG. 1, but taken from yet another perspective.
Figure 6:
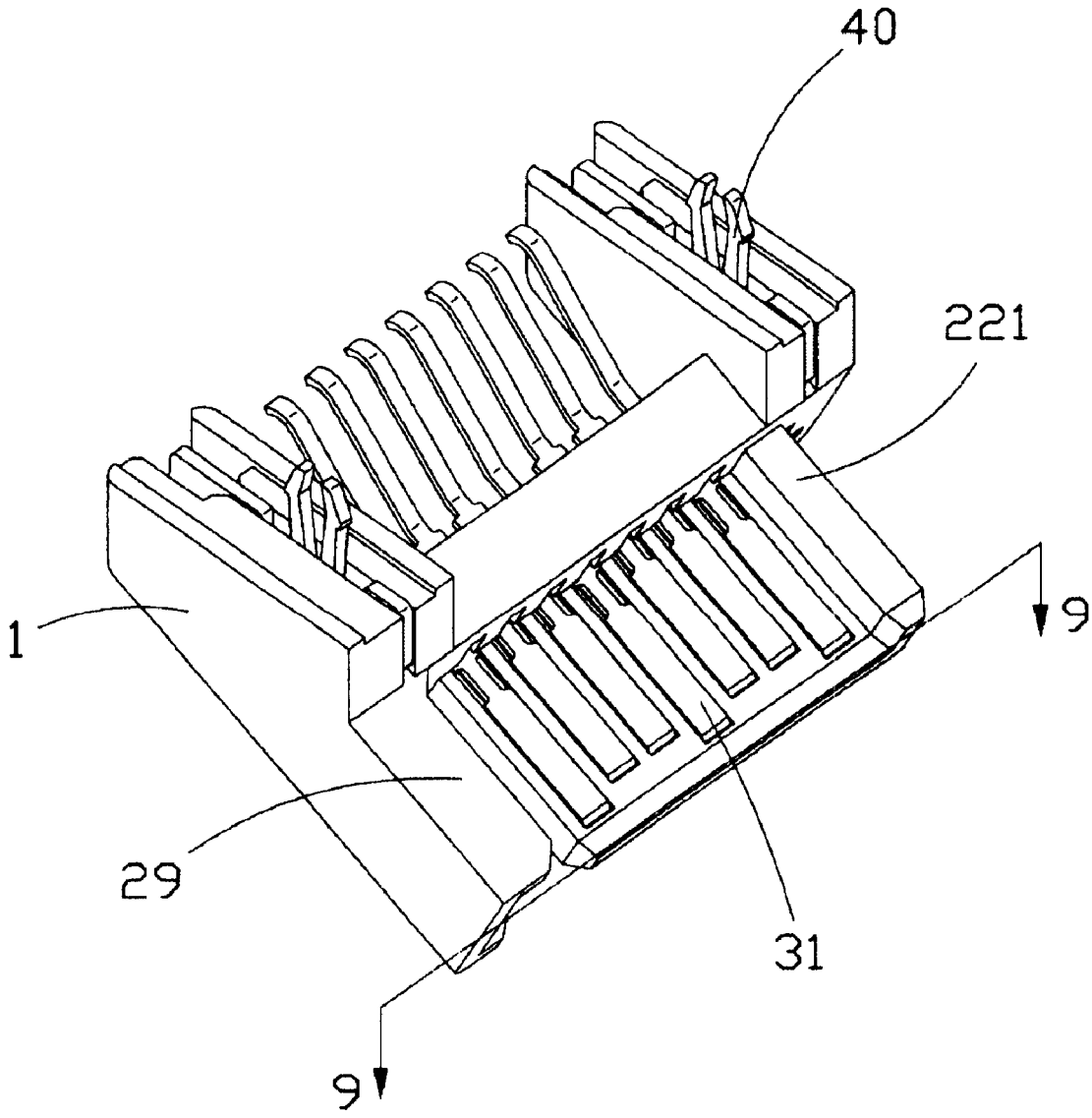
FIG. 6 is an assembled perspective view of FIG. 5.

Referring to FIGS. 1 and 2, an electrical connector 1 in accordance with the present invention comprises an insulative housing 20, a plurality of electrical contacts 30 and a pair of metallic board locks 40.

Figure 7:
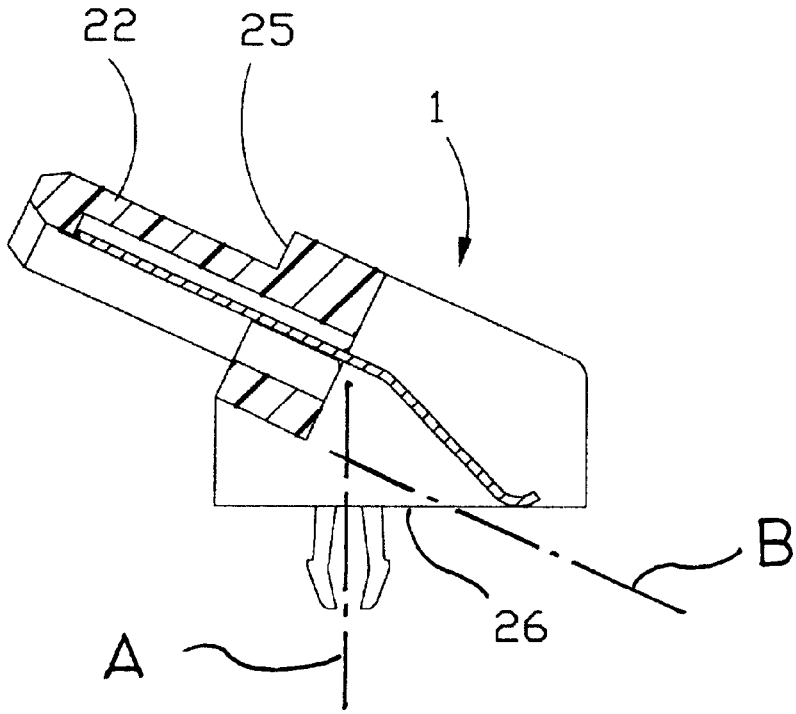
FIG. 7 is a cross-sectional view taken along line 7—7 of FIG. 4.

The insulative housing 20 comprises a base portion 21 and a mating tongue 22 extending from the base portion 21. The base portion 21 comprises a pair of opposite mounting ends 23, a beam section 24 extending between and connecting the mounting ends 23 and a shoulder 29 extending from one of the mounting ends 23 beside one end of the mating tongue 22. The shoulder 29 defines a U-shaped channel 290 extending therethrough. The base portion 21 defines a mating face 25 extending through the mounting ends 23 and the beam section 24, a mounting face 26 on bottom faces of the mounting ends 23, through which the electrical connector 1 is mounted to a printed circuit board (not shown), a front face 27 connecting the mating and the mounting faces 25, 26, and a rear face 28 opposite to the front face 27. Referring also to FIG. 7, the mating face 25 is obliquely arranged with respect to the mounting face 26 in such a way that the mating tongue 22 extending from the mating face 25 defines an angle $\alpha$ with respect to the plane the mounting face 26 lies in. The angle $\alpha$ is preferred at the range of less than 90 degrees.

Figure 8:
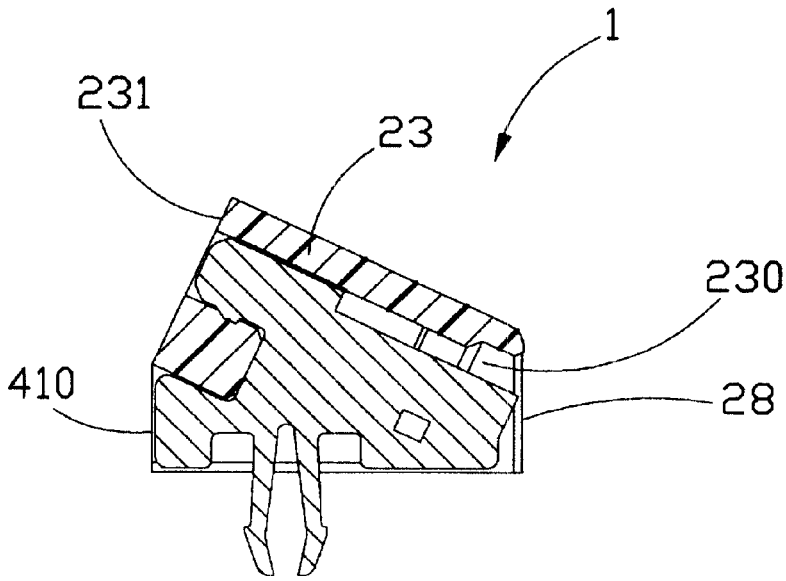
FIG. 8 is another cross-sectional view taken along line 8—8 of FIG. 2.
Figure 9:
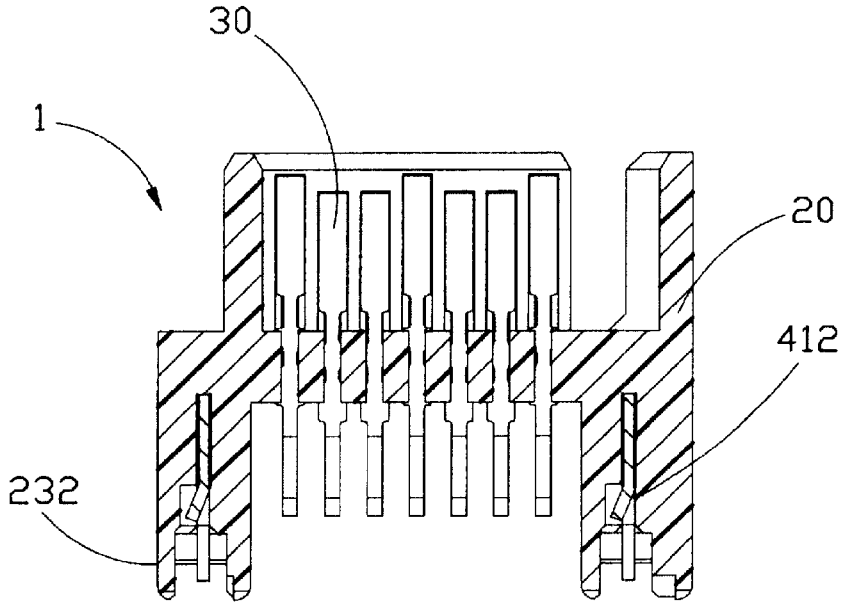
FIG. 9 is yet another cross-sectional view taken along line 9—9 of FIG. 6.
Figure 10:
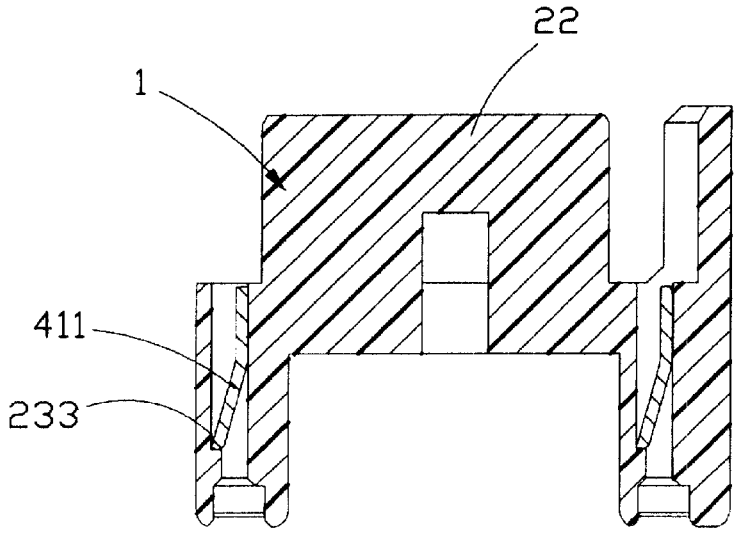
FIG. 10 is still another cross-sectional view of the electrical connector.

Referring also to FIGS. 8 to 10, each of the mounting ends 23 defines a cavity 230 extending from the rear and the mounting faces 28, 26 thereof, and a pair of passageways 230 extending respectively from the mating and the front faces 25, 27 and communicating with the cavity 230. Each of the mounting ends 23 comprises an upper step 233 protruding into a rear and relatively upper portion of the cavity 230 and a lower step 232 protruding into a rear and relatively lower portion of the cavity 230.

Referring also to FIGS. 3–7, the mating tongue 22 defines an under face 220 facing the printed circuit board (not shown) to which the electrical connector 2 is mounted and comprises a stop wall 221 extending downward at one end thereof distal from the shoulder 29. The under face 220 defines a plurality of terminal passageways 223 recessed therefrom and extending from the mating tongue 22 through the beam section 24.

Each of the electrical contacts 30 comprises a contact portion 31 accommodated in the passageway 223 on the under face 220 of the mating tongue 22, a fixing portion 32 extending straightly from the contact portion 31 and engaging with the insulative housing 20 to retain the electrical contact 30 to the insulative housing 20, a connection portion 33 extending angularly from the fixing portion 32 beyond the beam section 24 into between the mounting ends 23 of the insulative housing 20, and a tail portion 34 extending angularly from the connection portion 34 to abut against the printed circuit board (not shown) to which the electrical connector 1 is mounted.

Each of the board locks 40 comprises a generally planar retaining portion 41 and a locking portion 42 extending downwardly from the retaining portion 41. The retaining portion 41 is formed with a pair of spaced teeth 410 at a front section thereof, a rearwardly-extending upper tab 411 deflected sidewardly from adjacent a front section thereof and a rearwardly-extending lower tab 412 deflected sidewardly from adjacent a rear section thereof. The locking portion 42 comprises a pair of spaced legs 420.

Figure 11:
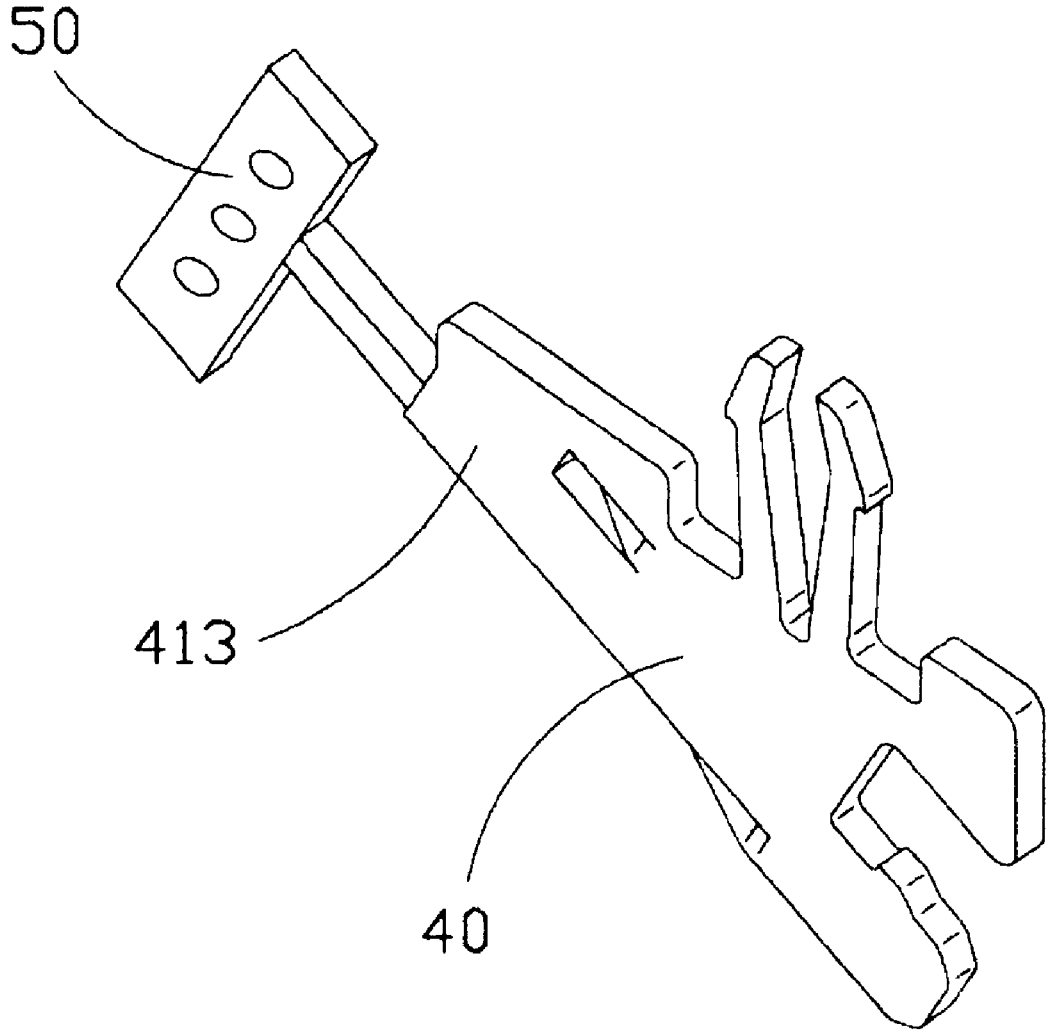
FIG. 11 is a perspective view of a board lock of the electrical connector when still connecting with a carrier strip.

Referring also to FIGS. 8 and 11, the board lock 40 is connected to a carrier strip 50 at a rear section 413 of the retaining portion 41 thereof. In such a way, the board lock 40 is inserted in a forward and upward direction B into the cavity 230 of the mounting end 230 of the insulative housing 20. The direction B defines an angle $\beta$ with respect to a direction which perpendicular to the mounting face 26 of the insulative housing 20. The angle $\beta$ is identical to the angle $\alpha$ although it could be other degrees under the condition of less than 90 degrees.

The spaced teeth 410 of the board locks 40 are received in the passageways 231 of the insulative housing 20 to stop the board locks 40 from forwardly and downwardly escaping from the insulative housing 20. The upper and the lower tabs 411, 412 are engaged with the upper and the lower steps 233, 232 of the insulative housing 20 to prevent the backward and downward movement of the board locks 40. In such a way, the board locks 40 are reliably secured to the insulative housing 20 and after the electrical connector 1 is mounted to the printed circuit board, the retention between the legs 420 of the locking portions 42 of the board locks 40 significantly enhances the retention between the insulative housing 20 and the printed circuit board.

It is noted that referring to FIG. 7, in this embodiment the mounting end 23 of the U-shaped base portion 21 includes a triangular pier below an imaginary line B which extends along a the lower oblique plane of the beam section 24 so as to support the angled housing 20 wherein a dimension of such a triangular pier of one mounting section along a longitudinal direction of the housing under the shoulder 29 is larger than that of the other which is not located under the shoulder 29. Moreover, the center line A of the board lock 40 may be aligned with a position along the longitudinal direction where the contacts 30 are just leaving the back face of the beam section 24. Those arrangements may provide a reliable engagement between the instant slanted type serial ATA connector and the printed circuit board on which the serial ATA connector is seated.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a base portion and a mating tongue extending from the base portion, the base portion comprising a pair of mounting ends and a shoulder extending from one of the mousing ends beside the mating tongue, each of the mounting ends defining a mounting face located in a first plane, the mating tongue extending in a second plane defining an angle less than 90 degrees relative to the first plane;

a plurality of electrical contacts extending from the mating tongue through the base portion; and a pair of board locks inserted in an upward and forward direction into the mounting ends of the base portion of the insulaitve housing, respectively;

wherein the mating tongue defines an under face and each of the electrical contacts comprises a contact portion located on the under face; and wherein the shoulder is formed with a U-shaped channel opening to the mating tongue; and wherein the mating tongue comprises a stop wall extending perpendicularly from an end thereof distal from the shoulder; and wherein each of the mounting ends defines a cavity extending from the bottom face thereof and a rear face thereof; and wherein each board lock comprises a retaining portion accommodated in the cavity and a locking portion extending downwardly from the retaining portion beyond the mounting face of the mounting end; and wherein each of the mounting ends comprises a pair of spaced passageways extending from a mating face thereof and communicating with the cavity; and wherein the retaining portion of the board lock comprise a pair of spaced teeth extending respectively into the passageways; and wherein the retaining portion of each board lock comprises an upper tab deflected sidewardly adjacent a front section thereof; and wherein each of the mounting ends is formed with an upper step to engage with the upper tab to prevent a backward and downward movement of the board lock; and wherein the retaining portion of each board lock comprises a lower tab sidewardly deflected adjacent a lower and rear portion thereof; and wherein each of the mounting ends is formed with a lower step to engage with the lower tab to prevent a backward and downward movement of the board lock.

* * * * *